US006145753A

United States Patent [19]

Yano et al.

[11] Patent Number: 6,145,753

[45] Date of Patent: Nov. 14, 2000

[54] EXPANSION VALVE

[75] Inventors: Masamichi Yano; Kazuhiko Watanabe, both of Tokyo, Japan

[73] Assignee: Fujikoki Corporation, Japan

[21] Appl. No.: 08/935,794

[22] Filed: Sep. 23, 1997

[30] Foreign Application Priority Data

Mar. 11, 1997 [JP] Japan ..... 9-056015

[51] Int. Cl.[7] ..... F25B 41/04

[52] U.S. Cl. ..... 236/92 B; 62/225; 251/900

[58] Field of Search ..... 62/225; 236/92 B; 251/900

[56] References Cited

U.S. PATENT DOCUMENTS

| | | | |
|---|---|---|---|
| 2,841,429 | 7/1958 | McCuistion | 251/900 |
| 4,191,203 | 3/1980 | Panigati | 251/900 |
| 5,040,905 | 8/1991 | Boyd | 384/130 |
| 5,172,727 | 12/1992 | Stoll et al. | 251/900 |
| 5,297,728 | 3/1994 | Yano et al. | 236/92 B |
| 5,361,597 | 11/1994 | Hazime et al. | 62/205 |

FOREIGN PATENT DOCUMENTS

| | | | |
|---|---|---|---|
| 38 19 114 | 12/1989 | Germany . | |
| 5-157406 | 6/1993 | Japan | 236/92 B |
| 7-198230 | 8/1995 | Japan . | |
| 762232 | 11/1956 | United Kingdom . | |

*Primary Examiner*—William E. Tapolcai
*Attorney, Agent, or Firm*—Rader, Fishman & Grauer

[57] ABSTRACT

A thermal expansion valve has a valve housing, a valve, a valve controller, a rod, and a seal ring. The valve housing has a first refrigerant passage, which is adapted to pass a liquid-phase refrigerant, and a second refrigerant passage, which is adapted to communicate a gas-phase refrigerant. The valve housing has a wall that separates the first and second passages. This wall has an opening that is in fluid communication with the first and second passages. The valve controls flow of the liquid-phase refrigerant entering the first passage. The valve controller is mounted on the valve housing and has a diaphragm and first and second chambers separated by the diaphragm. The rod extends between the diaphragm and the valve and is movably displaceable through the opening in the wall to open and close the valve to control the amount of the liquid-phase refrigerant entering the first passage. The seal ring is positioned in the opening and engages the opening surface of the wall and the rod to seal the opening. The seal ring has an X-shaped profile, with four sealed portions, two of which engage the opening surface and two of which engage the rod member to seal the opening against the opening surface of the wall and the rod.

13 Claims, 8 Drawing Sheets

EXPANSION VALVE

TECHNICAL FIELD OF THE INVENTION

The present invention relates to expansion valves and, more particularly, to expansion valves used for refrigerant utilized in refrigeration cycles of air conditioners, refrigeration devices and the like.

BACKGROUND OF THE INVENTION

In the prior art, these kinds of thermal expansion valves were used in refrigeration cycles of air conditioners in automobiles and the like. FIG. 7 shows a prior art thermal expansion valve in cross-section together with an explanatory view of the refrigeration cycle. The thermal expansion valve 10 includes a valve housing 30 formed of prismatic-shaped aluminum. The body 30 is associated with a refrigerant duct 11 of the refrigeration cycle having a first path, i.e., passage 32, and a second path, i.e., passage 34. The second passage 34 is placed above the first passage 32 with a distance inbetween. The first passage 32 is for a liquid-phase refrigerant passing through a refrigerant exit of a condenser 5 through a receiver 6 to a refrigerant entrance of an evaporator 8. The second passage 34 is for a liquid-phase refrigerant passing through the refrigerant exit of the evaporator 8 toward a refrigerant entrance of a compressor 4.

An orifice 32*a* for the adiabatic expansion of the liquid refrigerant supplied from the refrigerant exit of the receiver 6 is formed on the first passage 32, and the first passage 32 is connected to the entrance of the evaporator 8 via the orifice 32*a* and a passage 321. The orifice 32*a* has a center line extending along the longitudinal axis of the valve housing 30. A valve seat is formed on the entrance of the orifice 32*a*. A valve member, such as a ball, 32*b* supported by a valve member support 32*c* forms a valve structure together with the valve seat. The valve member 32*b* and the valve member support 32*c* are welded and fixed together. The valve member support 32*c* is fixed onto the valve member 32*b* and is also forced by a spring 32*d*, for example, a compression coil spring.

The first passage 32 where the liquid refrigerant from receiver 6 is introduced is a path of the liquid refrigerant, and is equipped with an entrance port 322 and a valve chamber 35 connected thereto. The valve chamber 35 has a floor portion formed on the same axis of the center line of the orifice 32*a*, and is sealed by a plug 39.

Further, in order to supply drive force to the valve member 32*b* according to an exit temperature of the evaporator 8, a small hole 37 and a large hole 38 having a greater diameter than the hole 37 is formed on the center line axis extending through the second passage 34. A screw hole 361 for fixing a power element member 36 working as a heat sensor is formed on the upper end of the valve housing 30.

The power element member, i.e., valve controller 36 is comprised of a stainless steel diaphragm 36*a*, an upper cover 36*d* and a lower cover 36*h* each defining an upper pressure activate chamber 36*b* and a lower pressure activate chamber 36*c* divided by the diaphragm two sealed chambers are formed above and under the diaphragm 26. A tube 36*i* is used to encloses a predetermined refrigerant working as a diaphragm driver liquid into the upper pressure activate chamber. The valve controller 36 is fixed to the valve housing 30 by a screw 361. The lower pressure activate chamber 36*c* is connected to the second passage 34 via a pressure hole 36*e* extending coaxially with the center line axis of the orifice 32*a*. A refrigerant vapor from the evaporator 8 flows through the second passage 34. The second passage 34 is a passage for gas phase refrigerant, and the pressure of the refrigerant vapor is applied to the lower pressure activate chamber 36*c* via the pressure hole 36*e*.

Further, inside the lower pressure activate chamber 36*c* is a heat sensing shaft 36*f* and an activating shaft 37*f* made of stainless steel. The heat sensing shaft 36*f* is exposed vertically inside the second passage 34 is slidably positioned through the second passage 34 inside the large hole 38. The shaft 36*f* contacts the diaphragm 36*a* transmit to the refrigerant exit temperature of the evaporator 8 to the lower pressure activate chamber 36*c*. This provides a driving force, in response to the displacement of the diaphragm 36*a* according to the pressure difference between the upper pressure activate chamber 36*b* and the lower pressure activate chamber 36*c*, by moving the shaft 36*f* inside the large hole 38. The activating shaft 37*f* is slidably positioned inside the small hole 37 and applies pressure to the valve member 32*b* against the spring force of the spring 32*d* according to the displacement of the heat sensing shaft 36*f*. The heat sensing shaft 36*f* comprises a stopper portion 312 having a large diameter, which portion 312 works as a receive member of the diaphragm 36*a*. The diaphragm 36*a* is positioned to contact its surface, a large diameter portion 314 contacts the lower surface of the stopper portion 312 at one end surface and is slideably movable inside the lower pressure activate chamber 36*c*. A heat sensing portion 318 contacts the other end surface of the large diameter portion 314 at an upper end surface of the shaft 36*f*. The other end surface of the shaft 36*f* is connected to the activating shaft 37*f*.

Further, the heat sensing shaft 36*f* is equipped with an annular sealing member, for example, an o-ring 36*g*, for securing the seal of the first passage 32 and the second passage 34. The heat sensing shaft 36*f* and the activating shaft 37*f* are positioned so as to contact each other. The activating shaft 37*f* also contacts the valve member 32*b*. The heat sensing shaft 36*f* and the activating shaft 37*f* together form a valve driving shaft or rod member.

In the above explained structure of a thermal expansion valve, a known diaphragm driving liquid is filled inside the upper pressure activating chamber 36*b* placed above an upper cover 36*d*. The heat of the refrigerant vapor from the refrigerant exit of the evaporator 8 the flows through the second passage 34 and to the diaphragm 36*a* via the shaft 36*f*. The valve driving shaft transmits heat to the diaphragm driving liquid.

The diaphragm driving liquid inside the upper pressure activate chamber 36*b* adds pressure to the upper surface of the diaphragm 36*a* by turning into gas in correspondence to the heat transmitted thereto. The diaphragm 36*a* is displaced in the upper and lower direction according to the difference between the pressure of the diaphragm driving gas added to the upper surface thereto and the pressure added to the lower surface thereto.

The displacement of the center portion of the diaphragm 36*a* to the upper and lower direction is transmitted to the valve member 32*b* via the valve member driving shaft and moves the valve member 32*b* close to or away from the valve seat of the orifice 32*a*. As a result, the refrigerant flow rate is controlled.

That is, the gas phase refrigerant temperature of the exit side of the evaporator 8 is transmitted to the upper pressure activate chamber 36*b*, and according to the temperature, the pressure inside the upper pressure activate chamber 36*b* changes, and the exit temperature of the evaporator 8 rises. When the heat load of the evaporator rises, the pressure inside the upper pressure activate chamber 36*b* rises, and accordingly, the heat sensing shaft 36*f* or valve member driving shaft is moved to the downward direction and pushes down the valve member 32*b* via the activating shaft 37, resulting in a wider opening of the orifice 32*a*. This increases the supply rate of the refrigerant to the evaporator, and lowers the temperature of the evaporator 8. In reverse, when the exit temperature of the evaporator 8 decreases and the heat load of the evaporator decreases, the valve member 32*b* is driven in the opposite direction, resulting in a smaller opening of the orifice 32*a*. As the supply rate of the refrigerant to the evaporator decreases, the temperature of the evaporator 8 rises.

In the thermal expansion valve explained above, an o-ring 40 is utilized as a sealing member, and the enlarged cross-sectional view of the o-ring 40 is shown in FIG. 8. In the drawing, o-ring 40 is formed by molding a rubber material, such as silicon rubber, into a ring shape, and the cross-sectional surface 410 has a round shape.

The mold used to form the o-ring is comprised of an upper mold and a lower mold each corresponding to the upper and lower half of the o-ring. Therefore, seams 420 and 422 corresponding to the matching portion of the upper and lower molds will be formed on the outer and inner peripheral of the ring.

When inserting the o-ring to the large hole 38 of the thermal expansion valve 10 in the arrow F direction, the outer seam 420 will be rubbed against the wall surface 38*a* of the hole 38, and a torsion stress shown by arrows $R_1$ and $R_2$ is added to the o-ring 40, resulting in a torsion of the o-ring. When such torsion occurs in the o-ring, the effect as a seal member will decrease, causing problems such as leakage.

Further, the seams 420 and 422 of the o-ring exist in the sealing portion, so it may cause leakage and other problems.

Even further, the rubbing resistance when utilizing the o-ring 40 as the seal member is too large.

Therefore, the object of the present invention is to provide a thermal expansion valve with the above problems solved.

SUMMARY OF THE INVENTION

In order to solve the problem, the thermal expansion valve of the present invention comprises a valve housing, a valve controller mounted on the valve body, a diaphragm forming one sealed chamber defined inside said valve controller and another sealed chamber, and a rod member for controlling the opening of the valve by a displacement of said diaphragm occurring by the pressure difference of said sealed chambers, wherein said rod member controls the flow rate of the refrigerant by the opening of said valve, characterized in that an x-ring is mounted on said rod member.

Further, the thermal expansion valve of the present invention includes a valve housing comprising a first passage wherein a liquid-phase refrigerant passes toward an evaporator and a second passage wherein a gas-phase refrigerant passes from the evaporator to a compressor, an orifice mounted inside said first passage, a valve means for controlling the amount of refrigerant passing said orifice, a valve controller mounted on said valve housing having a diaphragm being displaced by sensing the temperature of said gas-phase refrigerant, and a rod member working as a heat sensing shaft for driving said valve means by the displacement of said diaphragm, wherein said rod member is mounted slidably inside a through hole connecting said first and second passages, and an x-ring is equipped between said rod member and said through hole.

Still further, the thermal expansion valve of the present invention comprises a valve housing, a high pressure passage and a low pressure passage mounted on said valve body for flowing a refrigerant, an orifice mounted perpendicular to said low pressure passage for connecting said high pressure passage and said low pressure passage and having a valve opening connected to said low pressure passage, a valve body contacting and parting from said valve opening, and a rod member mounted through said orifice for contacting and parting said valve means against the valve opening, wherein said rod member further comprises an x-ring formed between said valve body.

The thermal expansion valve having the above structure includes an x-ring working as a seal member mounted on the rod member for controlling the opening of the valve by driving the valve means, so that the torsion and deformation of the sealing member could be prevented, and the occurrence of leakage as a result could also be prevented.

Further, there is no seam formed on the sealing member or x-ring, so that occurrence of leakage could be prevented.

Further, the resistance between the x-ring and the corresponding member could be reduced.

DETAILED DESCRIPTION

Figure 1:
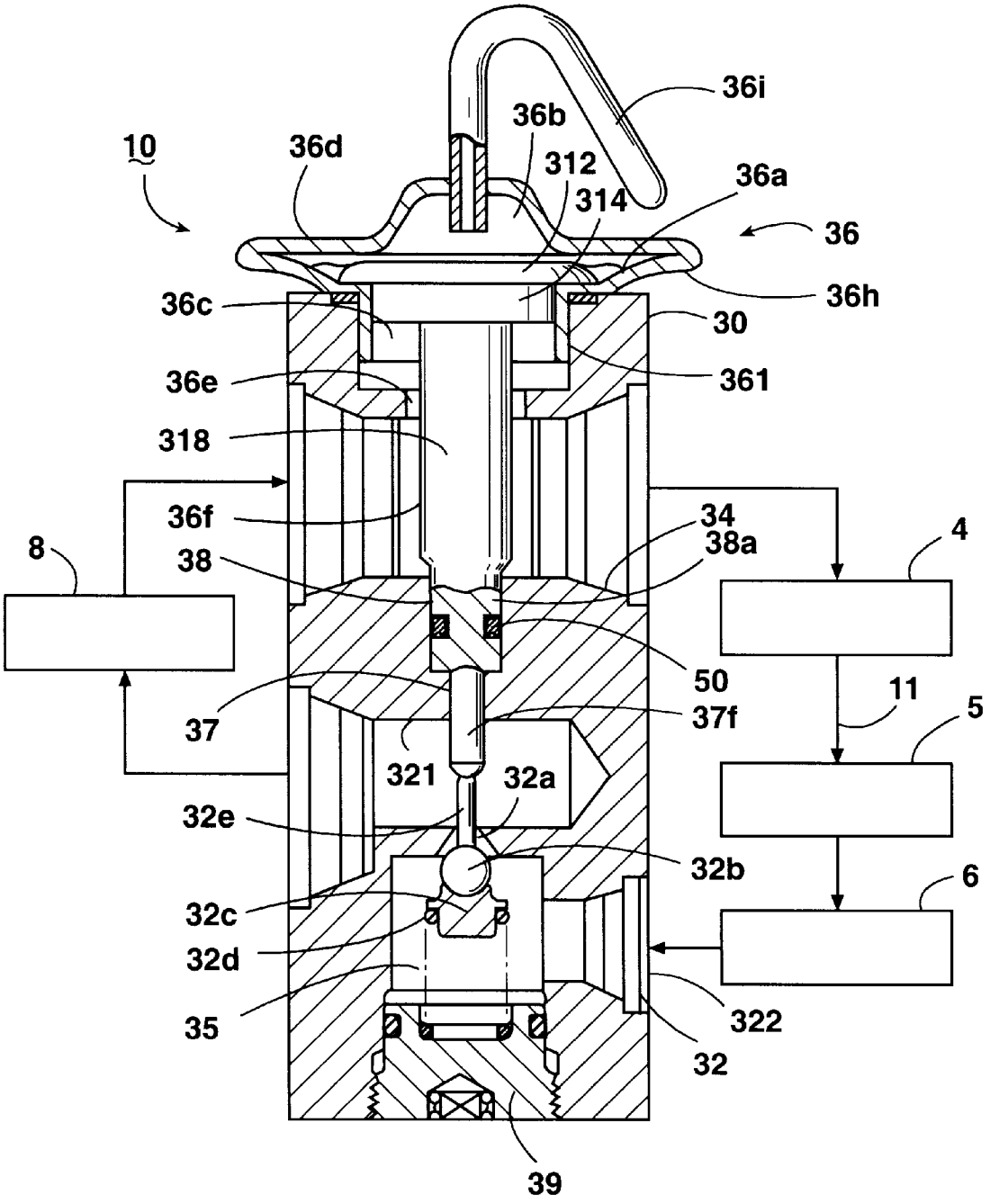
FIG. 1 is a vertical cross-sectional view showing one embodiment of the thermal expansion valve of the present invention.
Figure 2:
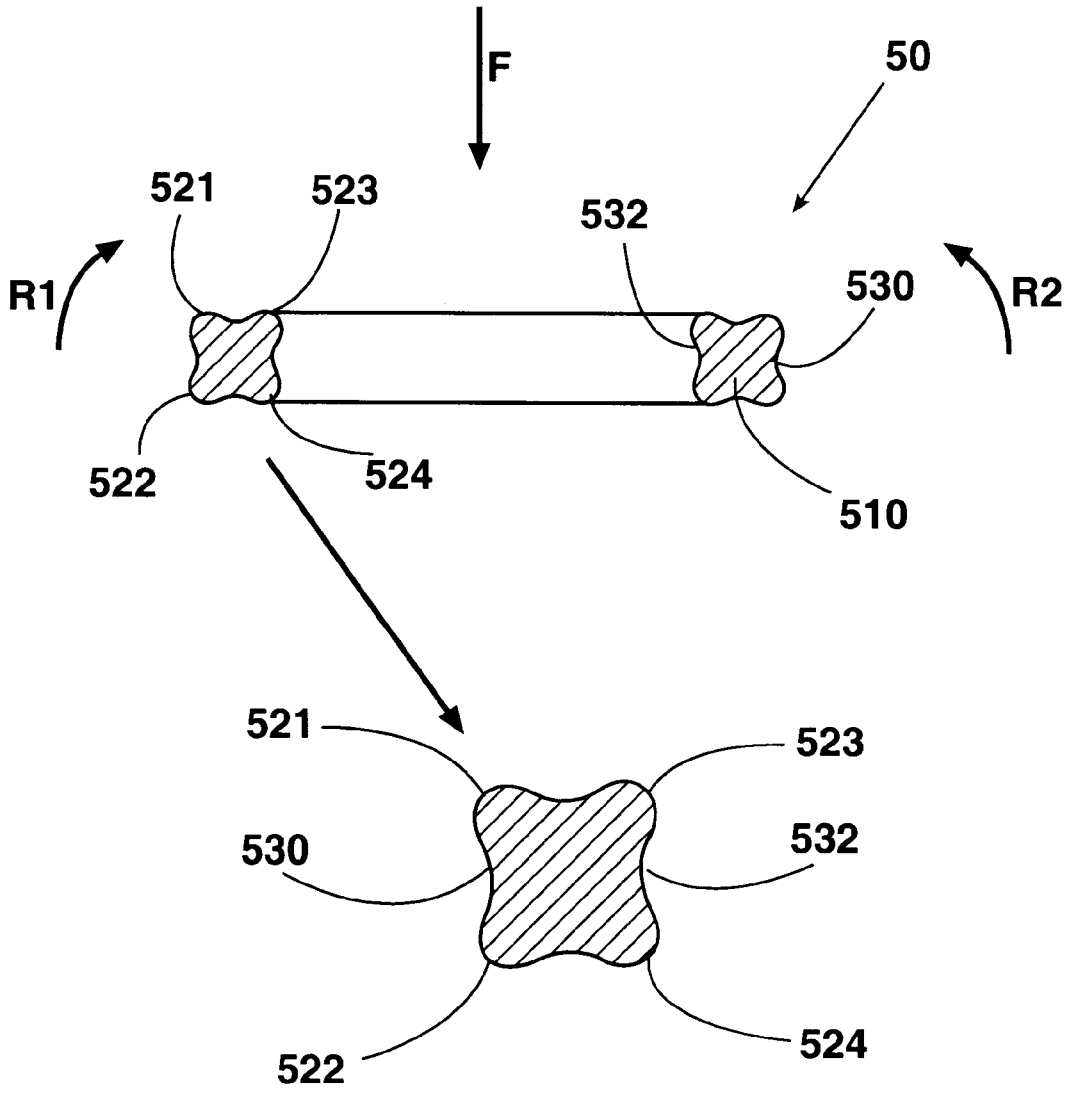
FIG. 2 is a cross-sectional view of the x-ring explaining the embodiment of FIG. 1.

FIG. 1 is a vertical cross-sectional view showing one embodiment of the thermal expansion valve of the present invention, and FIG. 2 is a cross-sectional view of the x-ring shown in FIG. 1.

Figure 7:
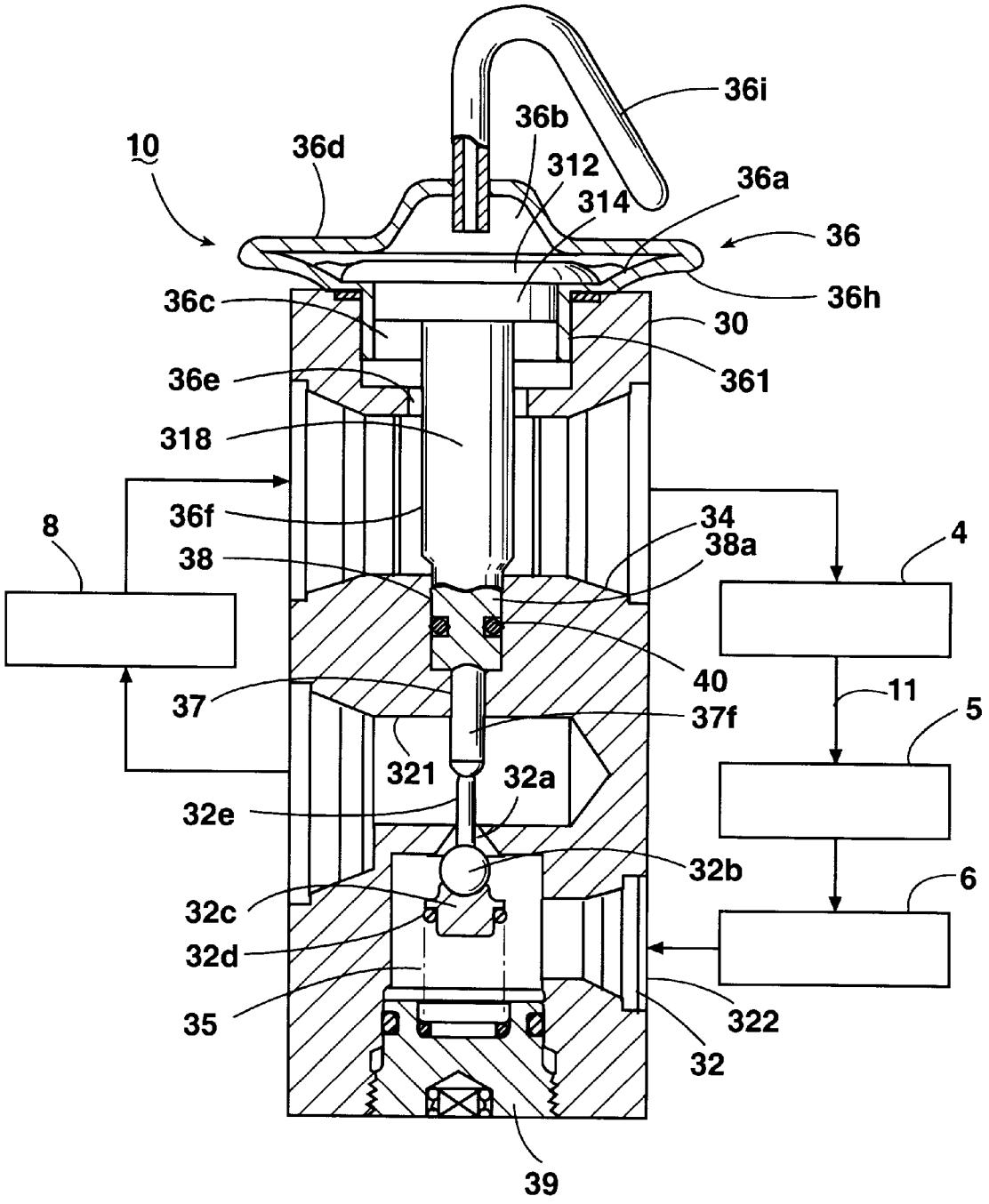
Fig. 7 (PRIOR ART)
FIG. 7 is a vertical cross-sectional view showing the structure of the prior art thermal expansion valve.
Figure 8:
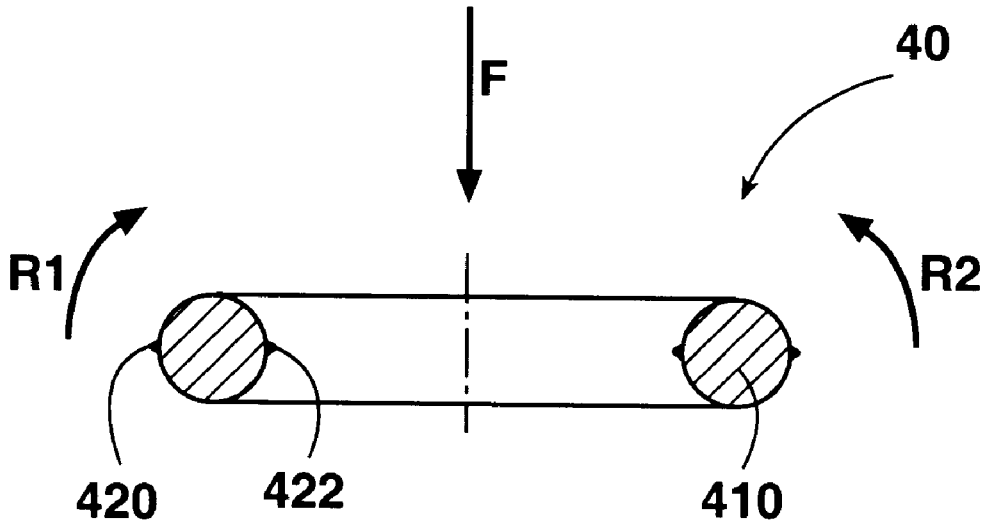
Fig. 8 (PRIOR ART)
FIG. 8 is a cross-sectional view of the o-ring explaining the structure of FIG. 7.

In FIG. 1, 50 shows an x-ring mounted on a rod member 36*f*, but the other structures are the same as FIG. 7, and the same reference numbers show the same elements.

In FIG. 2, the cross section 510 of the x-ring 50 comprises of four lip seal portions 521, 522, 523, and 524 formed on the four ends of the x-ring.

Of the four lip seal portions, the two lip seal portions 521 and 522 are positioned outwardly which portions rub against the well surface 38*a*. In the present embodiment, lip seal portions 521 and 522 will rub against the well surface 38*a* of the large hole 38. However, rolling movement caused by torsion of the x-ring 50 caused by the torsion stress shown by arrows $R_1$ and $R_2$ occurring when pushed toward the arrow F direction in an inner wall 38*a* of the large hole 38 will be prevented. That is, the lower seal portion 522 will prevent the x-ring from rolling in $R_1/R_2$ direction. Similarly, when a rolling torsion is applied in the opposite direction, the upper seal portion 521 will prevent the x-ring from rolling in the opposite direction.

In the same way, the inner peripheral of the x-ring 50 will be rubbed against a rod member 36*f*. The by two lip seal portions 523 and 524 will prevent the x-ring from rolling, and leakage will not happen. Further, the leak caused from a seam formed on the ring will be solved.

As was explained above, the x-ring contacts the other members by a plurality of lip seal portions, so that seal will be achieved by only a small pressure to the lip portions.

Further, in the x-ring, the seams formed at the time of production will be positioned in the center concave portions 530 and 532, so that they will not interfere with the other members. Therefore, the extra pressure added between the x-ring and the other member will reduce, and the resistance between the two will be small and at a stable rate.

Further, by the embodiment described above, the thermal expansion valve will have a first passage where the liquid-phase refrigerant to be sent to the evaporator will pass, and a second passage for the gas-phase refrigerant to pass from the evaporator to the compressor, and the rod member for controlling the opening of the orifice by operating the valve means will be inserted slidably inside a hole penetrating the center of the first passage and the second passage.

The x-ring will be equipped as a sealing member of the through hole and the rod member.

Figure 3:
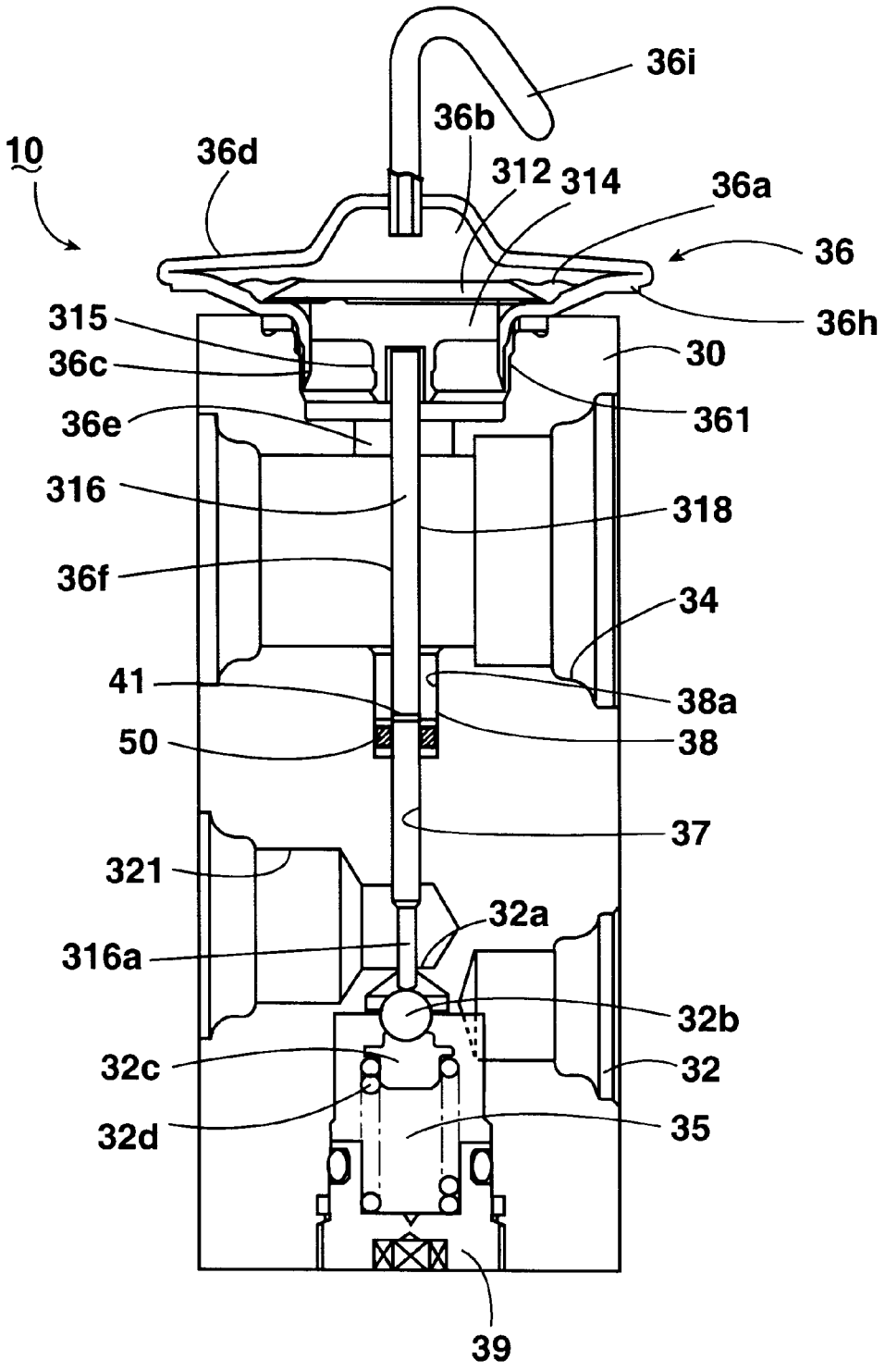
FIG. 3 is a vertical cross-sectional view showing another embodiment of the thermal expansion valve of the present invention.
Figure 4:
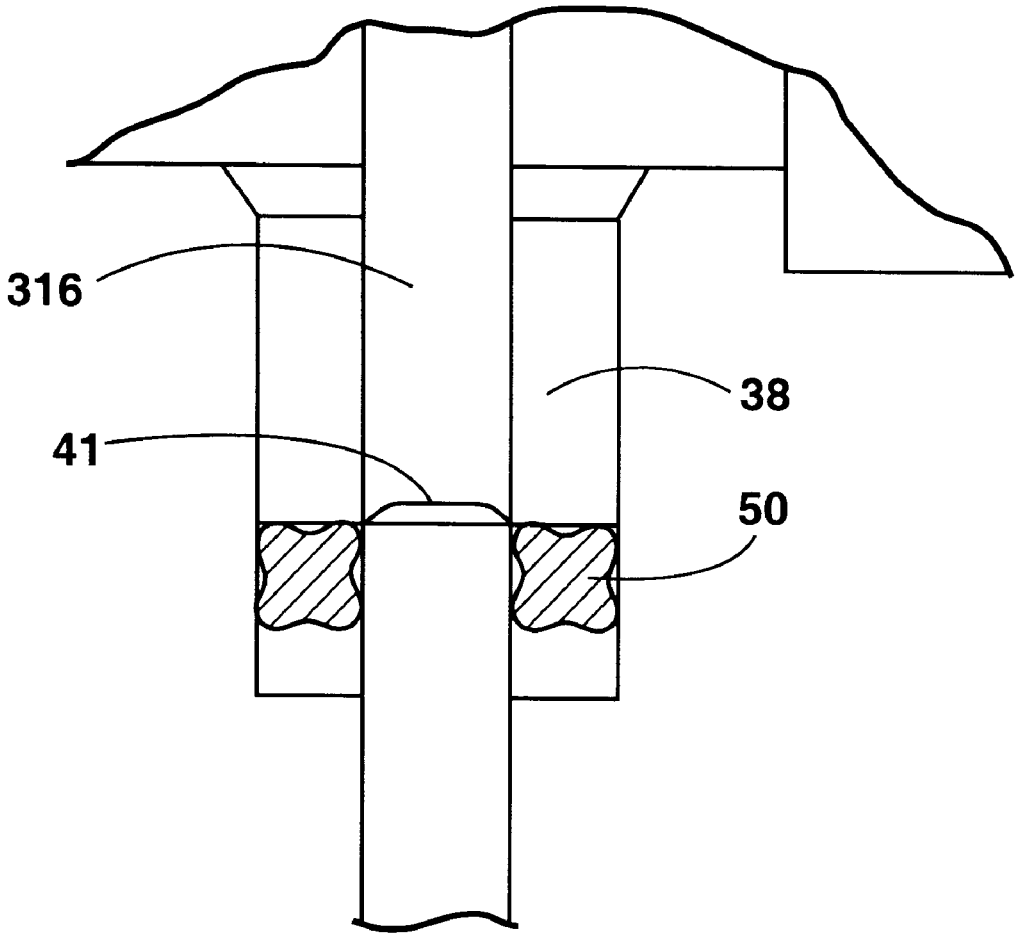
FIG. 4 is a cross-sectional view of the main portion of the embodiment of FIG. 3.

FIG. 3 is a cross-sectional view showing another embodiment of the present invention, and FIG. 4 is a cross-sectional view of the main portion of FIG. 3.

In FIG. 3, the valve housing 30 of the thermal expansion valve 10 comprises a first passage 32 and a second passage 34, and an orifice 32*a* will be equipped inside the first passage 32. The opening rate of the orifice 32*a* will be controlled by a spherical valve member 32*b*, e.g., a ball. The first passage 32 and the second passage 34 will be connected by through holes 37 and 38, and a thin shaft-type rod member 316 inserted slidably inside the through holes 37 and 38 will transmit the action of a diaphragm 36*a* to the valve member 32*b*.

A heat sensing portion 318 comprises a large diameter stopper portion 312 having a heat sensing shaft 36*f* and a diaphragm 36*a* contacting its surface and acting as a receiver portion of the diaphragm 36*a*, a large diameter portion 314 contacting the back surface of the stopper portion 312 at one end and the center of the other end formed at a protrusion 315 and slidably inserted to a lower pressure activate chamber 36*c*, and a rod member 316 whose end surface is fit inside the protrusion 315 of the large diameter portion 314 and the other end surface contacting the valve member 32*b* and connected thereto in an integral structure.

Further, in the present embodiment, a housing of the prior art thermal expansion valve is utilized as the valve housing 30. The rod member 316 forming the heat sensing shaft 36*f* will be driven back and forth across the passage 34 corresponding to the displacement of the diaphragm 36*a* of the valve controller 36, so that clearances 37 and 38 connecting the path 321 and the path 34 along the rod member 316 will be formed. In order to seal this clearance, the x-ring to be fit to the outer peripheral of the rod member 316 will be positioned inside the large hole 38, so that the x-ring exists between the two passages. Even further, as is shown in the enlarged view of the large hole 38 of FIG. 4, a push nut 41 working as a self-locking nut is fixed onto the rod member 316 in a position inside the large hole 38 contacting the x-ring 50, so that the x-ring will not be moved by the force added thereto by the spring coil 32*d* and the refrigerant pressure inside the passage 321 in the longitudinal direction (the direction where the power element 36 exists). As for the rod member 316, it is formed to have a small diameter compared to the ones used in the prior art thermal expansion valves (for example, 2.4 mm compared to the 5.6 mm of the rod of the prior art thermal expansion valve), so that it has a small heat transmission area or cross-sectional area, in order to prevent the occurrence of hunting phenomenon. Therefore, there is a possibility that the connection will be formed when the valve housing is formed to have the same structure as the one used for prior art thermal expansion valves. In order to prevent this and to securely fix the x-ring, the push nut 41 is effective. The connection between the rod member 316 and valve member 32*b* is formed in the small diameter portion 316*a*, and passes the orifice 32*a*. In such structure the operation thereof is the same as the embodiment of FIG. 1.

In the present embodiment, the two lip seal portions 521 and 522 of the four lip seal portions of FIG. 2 formed outwardly will be rubbed against the inner wall 38*a* of the large hole 38. The x-ring will contact the other members by two separate lip seal portions, so that torsion and deformation by the torsion stress shown by arrows $R_1$ and $R_2$ occurring when the x-ring is pushed in the inner wall 38*a* of the hole 38 in the arrow F direction will not happen. Therefore, leakage will be prevented. Of course, the leakage occurring by the seam formed in the ring will also be prevented.

Similarly, the inner peripheral of the x-ring 50 will be rubbed against the rod member 316, but torsion and deformation by the stress will not happen because it will contact the rod member by two lip seal portions 523 and 524.

As was explained above, the x-ring of the present embodiment contacts the other members by a plurality of lip seal portions, so the necessary pressure to the lip portions are small in order to achieve a seal.

Further, in the x-ring, the seams formed at the time of production will be positioned in the central concave portions 530 and 532, so that they will not interfere with the other members. Therefore, the extra pressure added between the x-ring and the other member will be reduced, and the resistance between the two members will be smaller and at a stable rate.

Therefore, the x-ring is suitable for a sealing member utilized in a rod member 316 having small diameters and operated by a small axis power.

Figure 5:
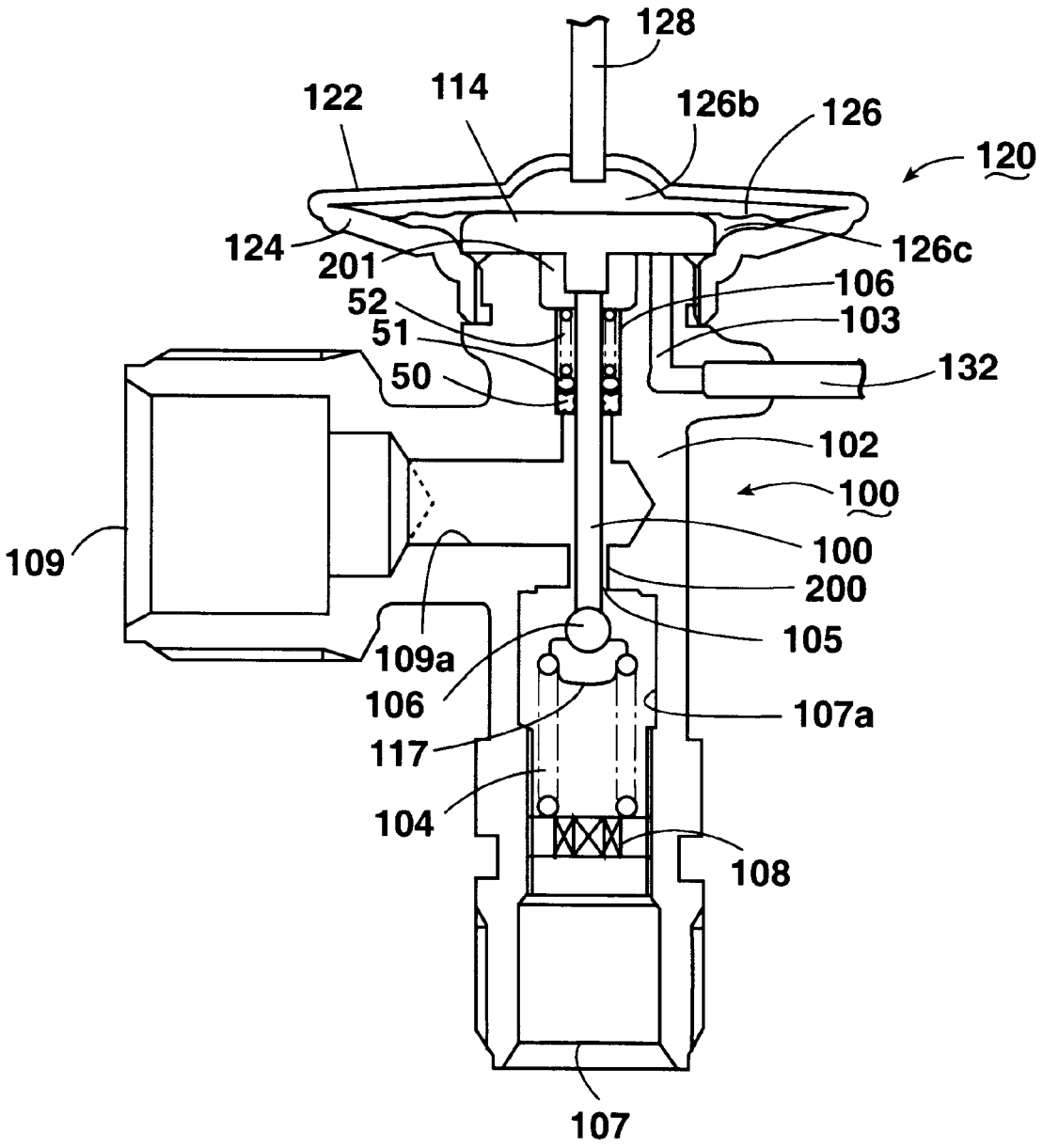
FIG. 5 is a vertical cross-sectional view showing another embodiment of the thermal expansion valve of the present invention.

FIG. 5 shows a vertical cross-sectional view of another embodiment of the present invention, and the basic structure thereof is shown in Japanese Patent Application Laid-Open No. H7-198230.

The drawing comprises a valve portion 100 for decompressing a liquid-phase refrigerant having high pressure, and a power element 120 for controlling the valve opening rate of said valve portion.

The power element 120 includes a diaphragm 126 held and welded to the outer peripheral of an upper cover 122 and a lower cover 124. The upper cover 122 and the lower cover 124 together with the diaphragm 126 constitute an upper pressure activate chamber 126*b* and a lower pressure activate chamber 126*c*.

The upper pressure activate chamber 126*b* is connected with the inside of a known heat sensing pipe (not shown) via a conduit 128. This heat sensing pipe is positioned in the exit portion of the evaporator in order to sense the temperature of the refrigerant near the exit of the evaporator, and converts the temperature to a pressure P1, which will be the pressure of the activate chamber 126*b*. When increased, said pressure P1 presses the diaphragm toward the lower direction, and opens the valve means 106.

On the other hand, a refrigerant pressure P2 of the exit of the evaporator is introduced to the pressure activate chamber 126*c* of the diaphragm 126 via a conduit 132.

This pressure P2 together with the force from a bias spring 104 works to close the valve member 106.

That is, the amount of refrigerant flowing into the evaporator will be controlled so that the valve is opened widely when the overheat rate (the difference between the refrigerant temperature of the evaporator exit and the evaporation temperature is taken out, so that it is the same as said pressure P1–P2) is large, and the valve is somewhat closed when the overheat rate is small.

The valve portion 100 comprises of an entrance 107 of a high pressure refrigerant and an exit 109 of a low pressure refrigerant and a valve housing 102 having a pressure hole 103 for connecting a pressure conduit 132, the valve housing 102 having a stopper portion 114 for limiting the displacement of the diaphragm to the lower direction and a rod member working as an activating shaft for transmitting the displacement of the diaphragm 126 to a valve member 106. The valve means 106 is supported by a valve member support 117 to contact and part from a valve opening 105. The valve member support 117 is supported by a bias spring 104, and the bias spring 104 is set together with a plug 108 that works as an adjustment member for the adjustment of the bias force of the spring. The rod member 100 traverses through a low pressure path 109*a* and passes an orifice 200, having one end fixed by a stopper member 114 and the other end being fixed to the valve member 106 inside a high pressure path 107*a*.

Further, the valve housing 102 has a concave 106 positioned in the upper direction of the low pressure passage 109*a* on the same concentric circle as the rod member 100. An x-ring 50, a washer 51, and a compression spring 52 is mounted on the concave 106, and the x-ring 50 is positioned between the rod member 100 and the valve housing 102. Therefore, the x-ring 50 is pressed by the compression spring 52 so as to seal the opening of the lower pressure passage 109*a* side of the concave 106, and the lower pressure activate chamber 126*c* is kept airtight. That is, the x-ring is utilized as a sealing member so that leakage occurring by the seam or the torsion of the sealing member could be prevented, and the seal could be achieved without producing too much slide resistance. Further, in FIG. 5, 201 is a ring member for holding the compression spring. Therefore, as is shown in FIG. 5, in the state where the valve member 106 is separated by a predetermined distance from the valve opening 105, the liquid-phase refrigerant having high pressure and high temperature flowing in from the condenser to the entrance 107 of the high pressure passage 107*a* will pass through the orifice 200 from the valve opening 105 into the lower pressure passage 109*a*. Further, in the process of flowing to the lower pressure path 109*a* from the orifice 200, the liquid-phase refrigerant expands rapidly and becomes a refrigerant having low pressure and low temperature.

Figure 6:
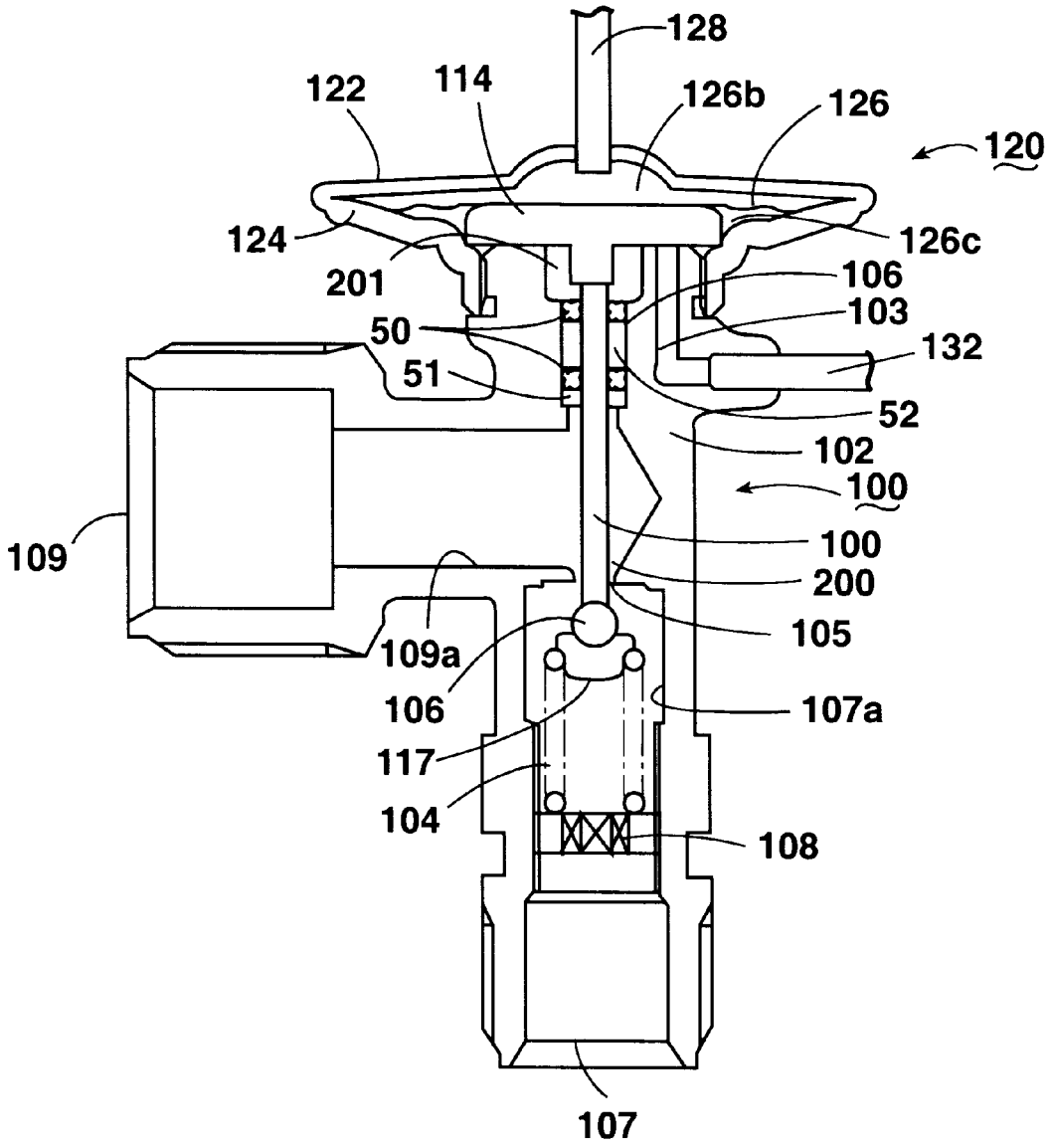
FIG. 6 is a vertical cross-sectional view showing yet another embodiment of the thermal expansion valve of the present invention.

FIG. 6 shows yet another embodiment of the present invention. The structure differing from FIG. 4 is that a washer 51 and a push 52 is utilized without using the compression spring. The other structures are the same as FIG. 4. In the embodiment shown in FIG. 6, the x-ring is also mounted as a sealing member to the rod member 100 of the concave 106, so that leakage occurring by the seam or the torsion of the sealing member could be prevented, and the seal could be achieved without producing too much slide resistance.

By the thermal expansion valve of the present invention, an x-ring is utilized as the sealing member of the rod member in a thermal expansion valve, so leakage of air by the seam or the torsion in the sealing member could be effectively prevented, and slide resistance could be reduced.

What is claimed is:

1. A thermal expansion valve, comprising:

a valve housing having a first refrigerant passage, which is adapted to pass a liquid-phase refrigerant, and a second refrigerant passage, which is adapted to pass a gas-phase refrigerant, the valve housing having a wall that separates the first and second passages, the wall having an opening connecting the first and second passages;

a valve that controls flow of the liquid-phase refrigerant entering the first passage;

a valve controller mounted on the valve housing, the valve controller having a diaphragm and first and second chambers separated by the diaphragm;

a rod operatively extending between the diaphragm and the valve, the rod being movably displaceable through the opening in the wall to open and close the valve to control the amount of the liquid-phase refrigerant entering the first passage; and a seal ring positioned in the opening and engaging the opening surface of the wall and the rod to seal the opening, wherein the seal ring has an X-shaped profile, consisting essentially of four joined sealing portions, two of which engage the opening surface and two of which engage the rod member to seal the opening against the rod and the opening surface of the wall.

2. A thermal expansion valve according to claim 1, wherein the rod is displaced to control the valve based on the pressure difference between the sealed chambers.

3. A thermal expansion valve according to claim 1, wherein the rod is displaced to control the valve based on the temperature of the gas-phase refrigerant in the second passage.

4. A thermal expansion valve according to claim 3, wherein the rod conducts heat from the gas-phase refrigerant to the second chamber, the rod being displaced as the diaphragm becomes displaced.

5. A thermal expansion valve according to claim 1, wherein the first passage is a low pressure flow path and the second passage is a high pressure flow path for the refrigerant.

6. A thermal expansion valve according to claim 5, wherein the opening is perpendicular to the second passage.

7. A thermal expansion valve according to claim 5, wherein the valve includes a valve member, and wherein the valve housing includes another wall having a valve opening with a seat that accommodates the valve member to close the valve opening.

8. A thermal expansion valve according to claim 7, wherein the valve further includes a valve member support that supports the valve member and a spring that biases the valve member support and the valve member toward the valve opening to close the valve opening.

9. A thermal expansion valve according to claim 8, wherein the rod has an extension that extends through the valve opening to contact the valve member.

10. A thermal expansion valve comprising:

a valve body;

a power element portion mounted on the valve body;

a diaphragm forming one sealed chamber defined inside said power element portion and another sealed chamber; and a rod member for controlling the opening degree of the valve by a displacement of said diaphragm occurring by the pressure difference of said sealed chambers;

wherein said rod member controls the flow rate of the refrigerant by the opening of said valve, further wherein an X-ring is mounted on said rod member.

11. A thermal expansion valve comprising:

a valve body comprising a first path where a liquid-phase refrigerant passes toward an evaporator and a second path where a gas-phase refrigerant passes from the evaporator to a compressor;

an orifice mounted inside said first path;

a valve which controls the amount of refrigerant passing said orifice;

a power element portion mounted on said valve body having a diaphragm to be displaced by sensing the temperature of said gas-phase refrigerant; and a rod member working as a heat sensing shaft for driving said valve by the displacement of said diaphragm;

wherein said rod member is mounted slidably inside a through hole connecting said first path and said second path, and an X-ring is equipped between said rod member and said through hole.

12. A thermal expansion valve comprising:

a valve;

a high pressure path and a low pressure path mounted on said valve body for flowing a refrigerant;

an orifice mounted perpendicular to said low pressure path for connecting said high pressure path and said low pressure path and having a valve opening connected to said low pressure path;

said valve contacting and parting from said valve opening; and a rod member mounted through said orifice for contacting and parting said valve against the valve opening;

wherein said rod member further comprises an X-ring formed between said valve body.

13. An expansion valve as described in claim 1, further comprising:

said opening is a through-hole having a portion enclosing said X-ring.

* * * * *